US006142821A

United States Patent [19]

Hwang

[11] Patent Number: 6,142,821

[45] Date of Patent: Nov. 7, 2000

[54] ELECTRICAL CONNECTOR ASSEMBLY WITH GUIDING DEVICE

[75] Inventor: Jeng-Yih Hwang, Irvine, Calif.

[73] Assignee: Hon Hai Precision Ind. Co., Ltd., Taipei Hsien, Taiwan

[21] Appl. No.: 09/373,809

[22] Filed: Aug. 13, 1999

[51] Int. Cl.[7] ..... H01R 13/627

[52] U.S. Cl. ..... 439/459; 439/405

[58] Field of Search ..... 439/459, 456, 439/492, 499, 405, 404

[56] References Cited

U.S. PATENT DOCUMENTS

| | | | |
|---|---|---|---|
| 4,260,209 | 4/1981 | Zell et al. . | |
| 4,359,257 | 11/1982 | Lopinski et al. . | |
| 4,648,677 | 3/1987 | Lang | 439/459 |
| 4,960,390 | 10/1990 | Davis et al. | 439/459 |
| 5,125,850 | 6/1992 | Locati | 439/404 |
| 5,338,221 | 8/1994 | Bowen et al. | 439/405 |
| 5,762,513 | 6/1998 | Stine | 439/404 |

*Primary Examiner*—Gary F. Paumen
*Attorney, Agent, or Firm*—Wei Te Chung

[57] ABSTRACT

An electrical connector assembly for link with a multi-conductors cable consists of an insulative connector housing attached with a plurality of contacts, a spacer, a terminal cover, and a strain relief. The terminal cover includes a pair of spring arms respectively outwardly extends from opposite ends thereof wherein each spring arm has a slot defined therein. A cavity is defined beside each spring arm of the terminal cover. The strain relief includes a pair of latching fingers outward extended from opposite ends thereof, and a pair of spaced guiding blocks integrally extending beside each latching finger wherein the guiding blocks and the latching finger on each end of the strain relief constitute a coplanar arrangement. Therefore, the latching fingers are capable of being rapidly orientated and stably inserted inside the slots of the corresponding spring arms of the terminal cover as soon as the guiding blocks of the strain relief fits within the corresponding cavities of the terminal cover.

3 Claims, 5 Drawing Sheets

ELECTRICAL CONNECTOR ASSEMBLY WITH GUIDING DEVICE

BACKGROUND OF THE INVENTION

1. Field of the Invention

The present invention relates to an electrical connector assembly for electrical link with a plurality of different electrical devices, and particularity to an electrical connector assembly electrically attached to a flat cable interconnecting the devices.

2. The Prior Art

U.S. Pat. No. 4,260,209 discloses a prior design on a terminal cover 12 having a plurality of juxtaposed passageways 28 defined on a bottom surface thereof for reception of each corresponding contact 56, and a strain relief 16 cooperating with terminal cover 12 to sandwich a flat cable 18 therebetween. Meanwhile, the flat cable 18 inversely extends toward the passageway 28 via the strain relief 16. Thus, the flat cable 18 with plural wires is respectively and perpendicularly penetrated by the contacts when passing through the passageway 28. In comparison with the U.S. Pat. No. 4,260,209, the U.S. Pat. No. 4,359,257 improves the structural relationship between the terminal cover and the strain relief so as to miniaturize the dimension of the finished connector assembly. U.S. Pat. No. 5,125,850 discloses another design that the strain relief 74 remains within the profiles of both the terminal cover 58 and the connector housing 18.

U.S. Pat. No. 5,762,513 further discloses a pair of latch arms 26 extended at opposite ends of the strain relief 5 of the electrical connector 3 thereby locking with the mating connector 2. Each latch arm 26 is formed apart from the latching finger 26 of the strain relief 5 locking with the connector housing 9.

However, the latching fingers of the strain relief indicated in the above-mentioned patents are often permanently deformed or buckled after improperly inserting beside the corresponding terminal cover. Certainly, it may be another reason that the all of the considerable forces are exercised on only latching fingers. Relatively, the retention between the strain relief and the terminal cover for securely sandwiching the inserted flat cable will become insufficient and inaccurate.

SUMMARY OF THE INVENTION

Accordingly, one object of the present invention is to provide an electrical connector assembly with a guiding device capable of rapidly orientating a strain relief on a terminal cover of the connector in multi-directions.

Another object of the present invention is to provide the electrical connector assembly with the guiding device capable of assisting the proper insertion of each latching finger of the strain relief into the terminal cover.

To fulfill the above mentioned objects, according to a preferred embodiment of the present invention, an electrical connector assembly for link with a multi-conductors cable consists of an insulative connector housing, a plurality of contacts, a spacer, a terminal cover, and a strain relief The terminal cover includes a plurality of juxtaposed passageways thereby receiving the multi-conductors cable in electrical engagement with the contacts. A pair of spring arms respectively outwardly extends from opposite ends thereof wherein each spring arm has a slot defined therein. A cavity is defined inside the terminal cover, beside each spring arm, and laterally communicates with the corresponding slot.

The strain relief includes a pair of latching fingers outward extended from opposite ends thereof, and a pair of spaced guiding blocks integrally extending beside each latching finger wherein the guiding blocks and the latching finger on each end of the strain relief constitute a coplanar arrangement, substantially. Therefore, when the guiding blocks of the strain relief further fit within the corresponding cavities of the terminal cover, the latching fingers are capable of being rapidly orientated and stably inserted inside the slots of the corresponding spring arms of the terminal cover.

BRIEF DESCRIPTION OF THE DRAWINGS

The invention will now be described by way of example with reference to the accompanying drawings in which like elements in different figures thereof are identified by the same reference numeral and wherein.

DETAILED DESCRIPTION OF THE PREFERRED EMBODIMENTS

Detailed reference will now be made to the preferred embodiments of the present invention.

Figure 3:
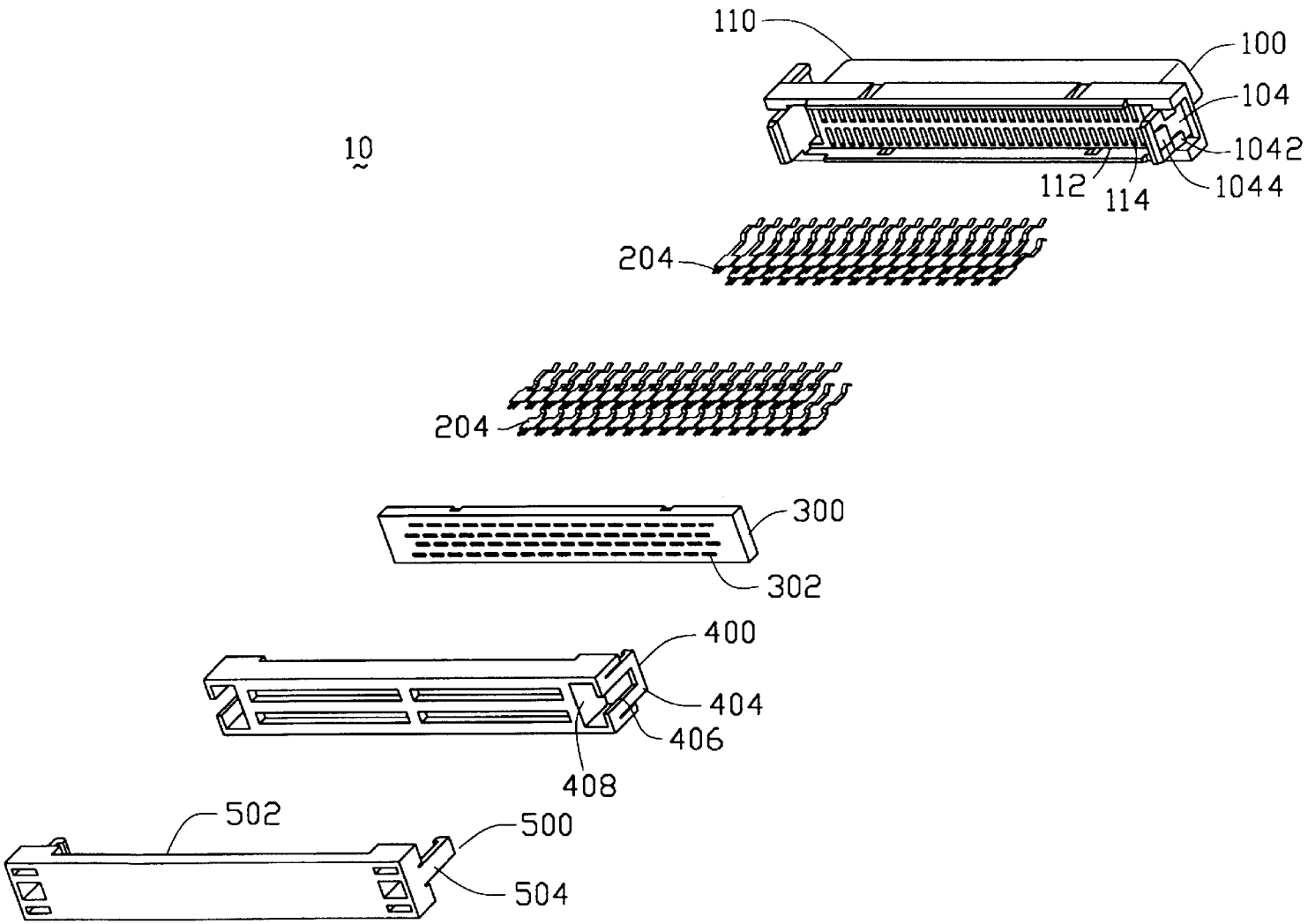
FIG. 3 is an explored view of the electrical connector assembly shown in FIG. 1.

With reference to FIG. 3, an electrical connector assembly 10 according to a preferred embodiment the present invention for electrically joint with a flexible multi-conductors cable (not shown), consists of an insulative connector housing 100, a plurality of contacts 200, a spacer 300, a terminal cover 400, and a strain relief 500.

Figure 1:
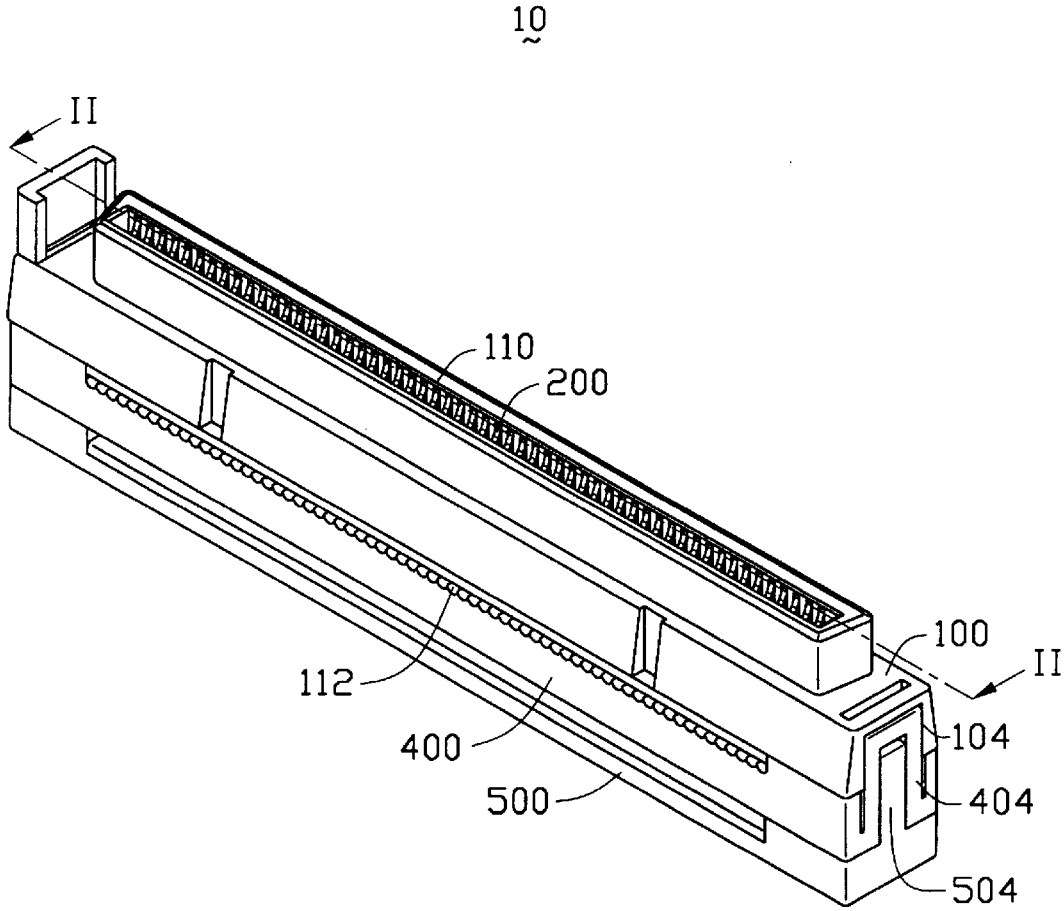
FIG. 1 is a top perspective view of an electrical connector assembly in accordance with a preferred embodiment of the present invention.

Further referring to FIGS. 1 & 3, the insulative connector housing 100 has a mating surface 110 with an input/output port, and a joint surface 112 opposite to the mating surface 110. A plurality of holes 114 in rows extends through the joint surface the joint surface 112. A pair of concaves 104 are respectively defined with opposite side ends of the connector housing 100, each concave 104 forms a first and second protrusions 1042, 1044 in alternative arrangement on a bottom wall thereof.

Figure 2:
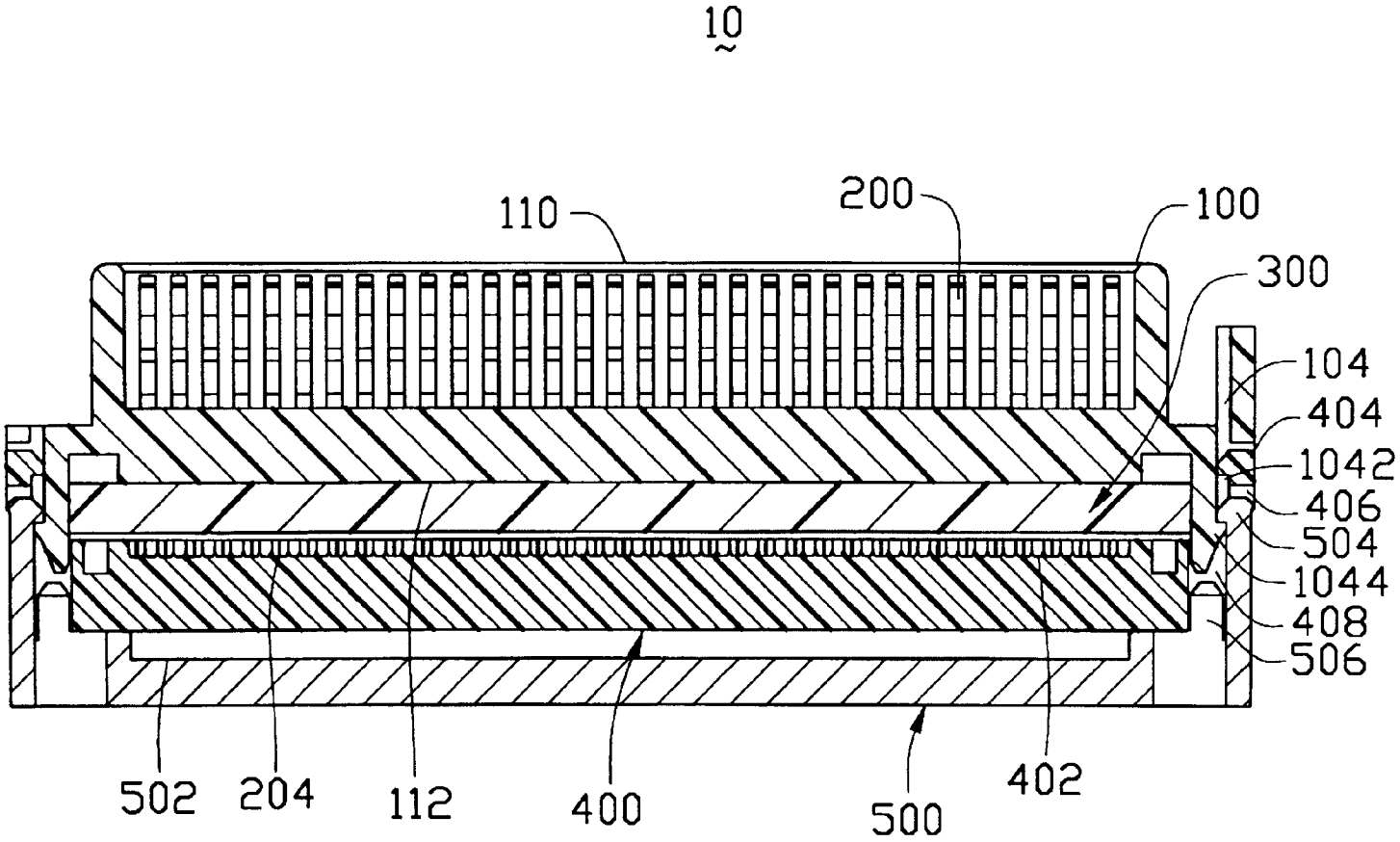
FIG. 2 is a cross-sectional view of the electrical connector assembly taken along line 2—2 of FIG. 1.

Further referring to FIGS. 2 & 3, a plurality of contacts 200 are respectively received within the holes 114 of the connector housing 110, and each contact 200 has a bladed tail 204 in fork protrudes out of the joint surface 112 of the connector housing 100. A spacer 300 is securely located between the joint surface 112 of the connector housing 100 and the terminal cover 400, and defines a plurality of apertures 302 which are inserted through by the bladed tails 204 of the corresponding contacts 200 thereby orientating the tail 204 therein.

Figure 4:
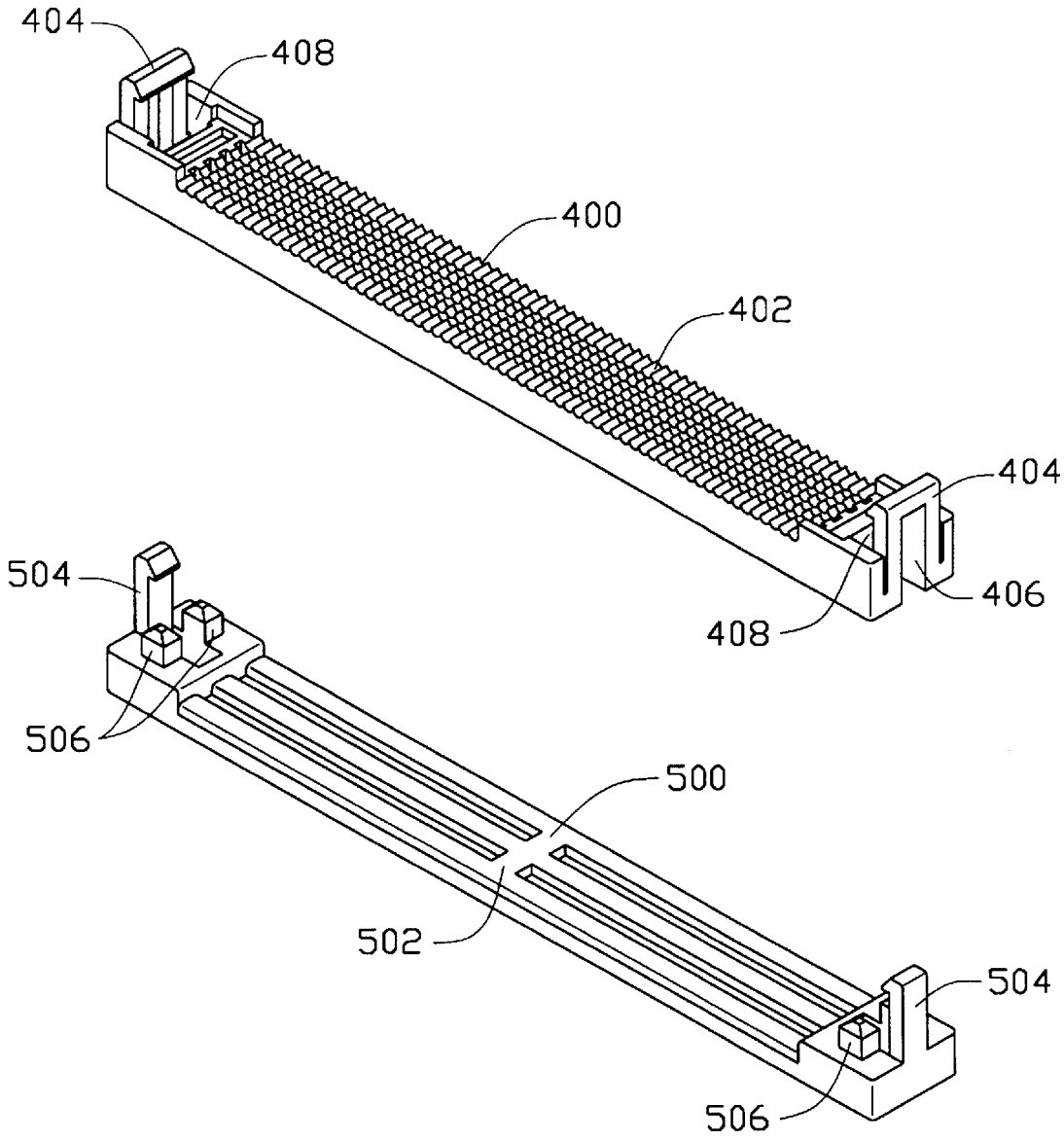
FIG. 4 is a top perspective view of a terminal cover and a strain relief for use with the electrical connector assembly shown in FIG. 1.

The terminal cover 400 as shown in FIGS. 2–4 includes a plurality of juxtaposed passageways 402 defined an upper surface thereof thereby positioning the multi-conductors of the cable thereon and permitting that the tails 204 of the contacts 200 perpendicularly engage the multi-conductors via inserting through a insulative layer of the cable (not shown) for electrical connection. A pair of spring arms 404 respectively outwardly extend from opposite outermost ends of the terminal cover 400, each spring arm 404 has a slot 406 defined therein. A cavity 408 is defined through the terminal cover 400, beside each spring arm 404 wherein the cavity 408 laterally communicates with the corresponding slot 406 as shown in FIG. 5.

Figure 5:
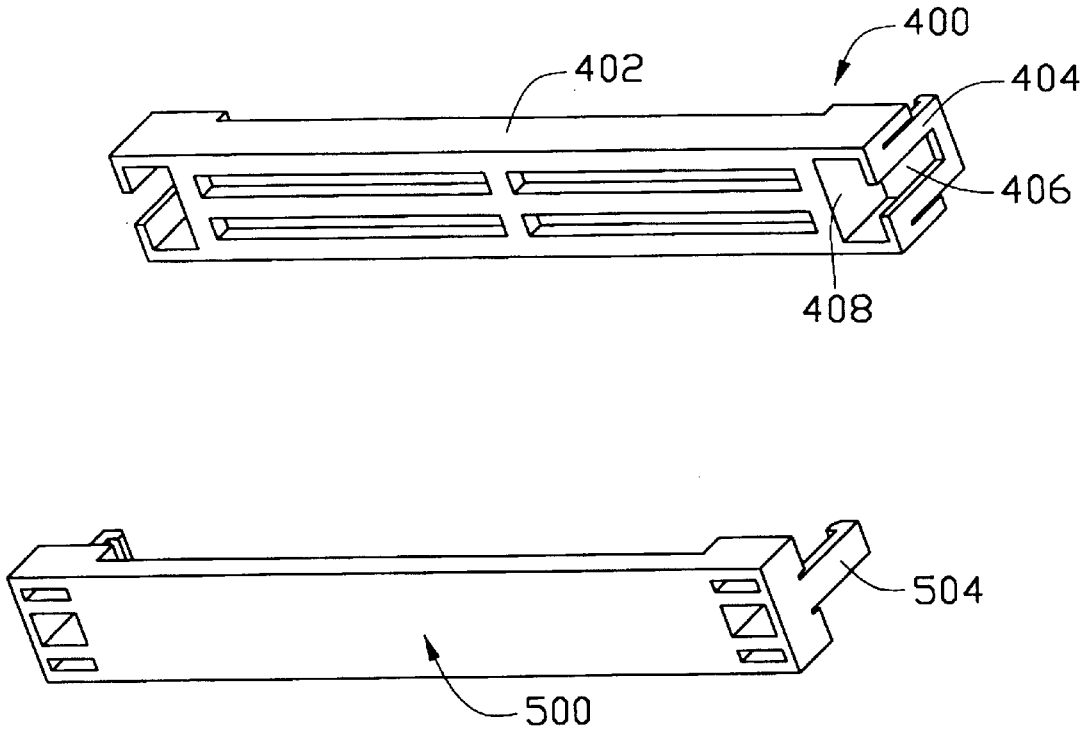
FIG. 5 is a bottom perspective view of the terminal cover and the strain relief shown in FIG. 4.

The strain relief 500 as shown in FIGS. 4 & 5 for avoiding over pulling the cable includes a pair of latching fingers 504 extended from opposite outermost ends thereof, and a pair of spaced guiding blocks 506 integrally extending out of the strain relief 500, beside each latching finger 504. Each guiding block 506 is spaced from the corresponding latching finger 504 thereby remaining in the resiliency of the latching finger 504. The guiding blocks 506 and the latching fingers 504 on each of the outermost ends of the strain relief 500 constitute a coplanar arrangement, substantially. A planar compression surface 502 is located between the guiding blocks 506 on opposite ends of the strain relief 500 for inversely and pressingly positioning the cable thereon.

In assembly shown in FIGS. 2–4, the spacer 300 is securely sandwiched between the joint surface 112 of the connector housing 100 and the terminal cover 400 for reception of the cable and the tails 204 of the contacts 200 as aforementioned. Meanwhile, the terminal cover 400 is retained to the connector housing 100 by means that the spring arms 404 are received within the corresponding concave 104 and lock with the first protrusions 1042 in the concaves 104. Then, the guiding blocks 506 of the strain relief 500 further fit within the corresponding cavities 408 of the terminal cover 400 from the rear thereof thereby rapidly orientating and then stably inserting the latching fingers 504 inside the slots 406 of the corresponding spring arms 404 of the terminal cover 400. The latching fingers 504 of the strain relief 500 entering into the slots 406 of the terminal cover 400 are capable of locking with the corresponding second protrusions 1044 of the connector housing 100. Meanwhile, a segment of the cable extending between the terminal cover 400 and the spacer 300 can be pressingly and inversely sandwiched between the compression surface 502 of the strain relief 500 and the terminal cover 400 as soon as the strain relief 500 is secured into the connector housing 100. The result of the assembly is shown in FIG. 1 except the cable.

While the present invention has been described with reference to the specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical connector assembly for linking with an external multi-conductor cable, comprising:

an insulative connector housing defining a mating surface and a joint surface opposite to the mating surface;

a plurality of contacts received within the connector housing, each having a bladed tail perpendicularly projecting out of the joint surface of the connector housing;

a terminal cover attached to the joint surface of the connector housing, having a plurality of juxtaposed passageways for reception of the cable conductors which perpendicularly engages with the corresponding tails of the contacts therein, a pair of spring arms respectively outwardly extended from opposite ends of the terminal cover and each having a slot defined therein, and a cavity defined inside the terminal cover, beside each spring arm; and a strain relief for avoiding over pulling the cable, having a pair of latching fingers extended from opposite ends thereof, and at least one guiding device integrally extending out of the strain relief and spaced adjacent each latching finger wherein the guiding device and the latching finger on each of the ends of the strain relief rapidly orient and then stably insert the latching finger inside the slot of the corresponding spring arm of the terminal cover as soon as the guiding device fits with the corresponding cavity of the terminal cover;

wherein the connector housing includes a pair of concavities formed on opposite ends thereof for reception of the corresponding spring arm of the terminal cover;

wherein each concavity further defines a first protrusion thereby locking with the corresponding spring arm of the terminal cover;

wherein each concavity further defines a second protrusion thereby locking with the corresponding latching finger of the strain relief;

wherein the slot of each spring arm laterally communicates with the corresponding cavity.

2. The electrical connector assembly as defined in claim 1, wherein the electrical connector assembly further includes a spacer securely located between the connector housing and the terminal cover and inserted through by the bladed tails of the contacts for orientation.

3. The electrical connector assembly as defined in claim 1, wherein the latching fingers of the strain relief extend along a direction which is the same as that of the spring arms of the terminal cover.

* * * * *